United States Patent [19]

Melgaard

[11] 4,116,612

[45] Sep. 26, 1978

[54] GAS MONITOR SYSTEM

[75] Inventor: Hans L. Melgaard, Minneapolis, Minn.

[73] Assignee: Despatch Industries, Inc., Minneapolis, Minn.

[21] Appl. No.: 764,212

[22] Filed: Jan. 31, 1977

[51] Int. Cl.[2] ..... F23H 5/02

[52] U.S. Cl. ..... 431/76; 236/15 E; 431/24

[58] Field of Search ..... 126/285 R, 285 B; 236/1 G, 45, 15 E; 431/20, 24, 22, 76, 346; 110/163

[56] References Cited

U.S. PATENT DOCUMENTS

| | | | |
|---|---|---|---|
| 3,788,795 | 1/1974 | Zeitlin | 431/20 X |
| 3,861,855 | 1/1975 | Seider | 431/76 |
| 4,039,123 | 8/1975 | Frankel | 126/285 B |
| 4,043,743 | 8/1977 | Seider | 431/76 |
| 4,046,318 | 9/1977 | Ripley | 126/285 B |

*Primary Examiner*—Edward G. Favors
*Attorney, Agent, or Firm*—James R. Haller

[57] ABSTRACT

A gas monitor system to monitor combustable or flammable gases present in the exhaust flue of the monitored equipment and to adjust the damper on a real time basis as the system is operated to continuously adjust the concentration of combustible or flammable gases in the monitored equipment. The system also includes self-check calibration circuitry to regularly check that the system is in calibration and that the sensor element in the exhaust has not suffered from a sensitivity decrease. Calibration gas is fed to the sensor on a regular basis. If the calibration circuitry does not complete a proper timing cycle, the system is disabled indicating that the instrument is out of calibration or the sensor is defective.

21 Claims, 2 Drawing Figures

GAS MONITOR SYSTEM

BACKGROUND OF THE INVENTION

1. Field of the Invention

The present invention relates generally to improvements in equipment monitoring systems and more particularly, pertains to new and improved gas monitor system wherein the combustible or flammable gases of the exhaust gas is monitored on a real time basis to continuously adjust the damper in the exhaust flue of the monitored equipment to control the concentration of the gases. Further, the system checks its own calibration on regular intervals to ensure that the system is not out of calibration or that the sensor has not suffered from a sensitivity decrease.

2. Description of the Prior Art

Those concerned with the control of the combustible or flammable gases in monitored equipment have long recognized the need for a reliable and accurate gas monitor system. The present invention fills this need.

Prior systems failed to accurately and reliably maintain the concentration of combustible or flammable gases in a prescribed range on a real time basis and failed to regularly check the calibration of the gas monitor system on a regular interval.

The prior art systems upon sensing a high concentration of combustible or flammable gases in the monitored equipment would operate to shut down the equipment to eliminate an explosive condition. When a shut-down in the monitored system occurred such as in a heating system, it was time consuming and expensive to restart the heating cycle of the system. Other prior art systems would sense a high concentration of combustible flammable gases, and upon sensing an explosive condition, would open a damper in the exhaust flue of the monitored equipment to exhaust the gases in the chamber. Other prior art systems would operate on an open-loop system permitting only minimal control of the damper of the monitored equipment. This invention fills the need by providing a closed-loop system to continually adjust the damper on a real time basis as the monitored equipment operates to maintain the concentration of combustible or flammable gases in the monitored equipment within a particular desired percentage range.

Other prior art systems would fail to calibrate gas monitor systems on a regular interval basis. The system was usually calibrated at installation and possibly on a periodic preventative maintenance basis, but depending upon usage and other factors including environmental operating conditions, the systems would sometimes go out of calibration resulting in dangerous amounts of combustible or flammable gases which would collect in the monitored equipment. This invention utilizes calibrating and timing circuitry to periodically discharge a measured amount of calibration gas to check the calibration of the gas monitor system.

SUMMARY

The present invention obviates the foregoing disadvantages of the prior art gas monitor systems by providing a relatively simple, yet reliable, gas monitor system which uses a closed-loop system to adjust a damper in an exhaust flue of the monitored equipment on a real time basis as the monitored equipment is operating to continuously control the concentration of combustible or flammable gases in the monitored equipment, and further, on a regular interval basis, checking the calibration of the system.

According to one embodiment of the present invention, there is provided a gas monitor system having a sensor in an exhaust flue of monitored equipment connected to a combustible or flammable gas monitor which connects to a control instrument to control a motor through a closed-loop which regulates the position of a damper in the exhaust flue on a real time basis. Circuitry maintains the concentration of the combustible or flammable gases within a desired percentage range for maximum permissible combustible or flammable gas load in the monitored equipment. Calibration circuitry also having time circuitry discharges a precise amount of combustible or flammable gas to the sensor raising the concentration indication. Additional timing circuitry prevents an alarm from sounding and the monitored equipment from shutting down during the calibration period, but if timing conditions are not satisfied, the alarm sounds, the damper locks open, and the out-of-calibration light lights indicating that the system is out of calibration or the sensor is defective. Additional circuitry sounds an alarm if the preset alarm time limit is exceeded during normal operation and opens the damper to rid the monitored equipment of combustible or flammable gas build-up.

A significant aspect and feature of the present invention is a closed-loop system to continually adjust the damper on a real time basis as monitored equipment is operating to continually maintain a safe concentration of combustible or flammable gases in the monitored equipment within a specific desired percentage range. By monitoring the level of the combustible or flammable gases concentration in the equipment and automatically adjusting the damper, the exhaust rate of the monitored equipment is automatically reduced as the concentration of combustible or flammable gases diminishes resulting in considerable fuel savings in the heated equipment.

An additional significant aspect and feature of the present invention is a regular interval calibration check to self-check the calibration of the gas monitor system to ensure that the sensor element of the explosive gas monitor system is not defective or that the system is not out of calibration.

Having briefly described the embodiment of the present invention, it is the principal object thereof to provide a new and improved gas monitor system.

An object of the present invention is the provision of maintaining the combustible or flammable gases concentration within a precise predetermined desired percentage range by operating the damper and controlling the exhaust rate for maximum permissable gas concentration. The exhaust rate is automatically reduced as the concentration of combustible or flammable gases diminish resulting in considerable fuel savings in the monitored equipment.

Another object of the invention is the provision of a closed-loop system to continually adjust the damper on a real time basis as the monitored equipment is operating to maintain the combustible or flammable gases concentration within the desired percentage range.

A further object of the invention is the provision of a regular interval calibration check of the gas monitor system on a regular basis to sense that the system is maintaining the combustible or flammable gas level within a precise percentage range and that the sensor is not defective. The calibration check discharges a precise amount of combustible or flammable gas near the sensor so that the system senses the gas to check the upper limit of the percentage range for the combustible or flammable concentration. If the upper limit is not exceeded, within a specific time period, the system is disabled for being out of calibration.

An additional object of the invention is the provision of alarm circuitry when the adjustable lower combustible flammable concentration is exceeded. Further, if the upper limit of the flammable concentration is exceeded, an additional circuitry actuates to shut down the monitored equipment.

BRIEF DESCRIPTION OF THE DRAWINGS

Other objects and many of the attendant advantages of this invention will be readily appreciated as the same becomes better understood by reference to the following detailed description when considered in connection with the accompanying drawings in which like references numerals designate like parts throughout the figure thereof and where.

DESCRIPTION OF THE PREFERRED EMBODIMENT

Figure 1A:
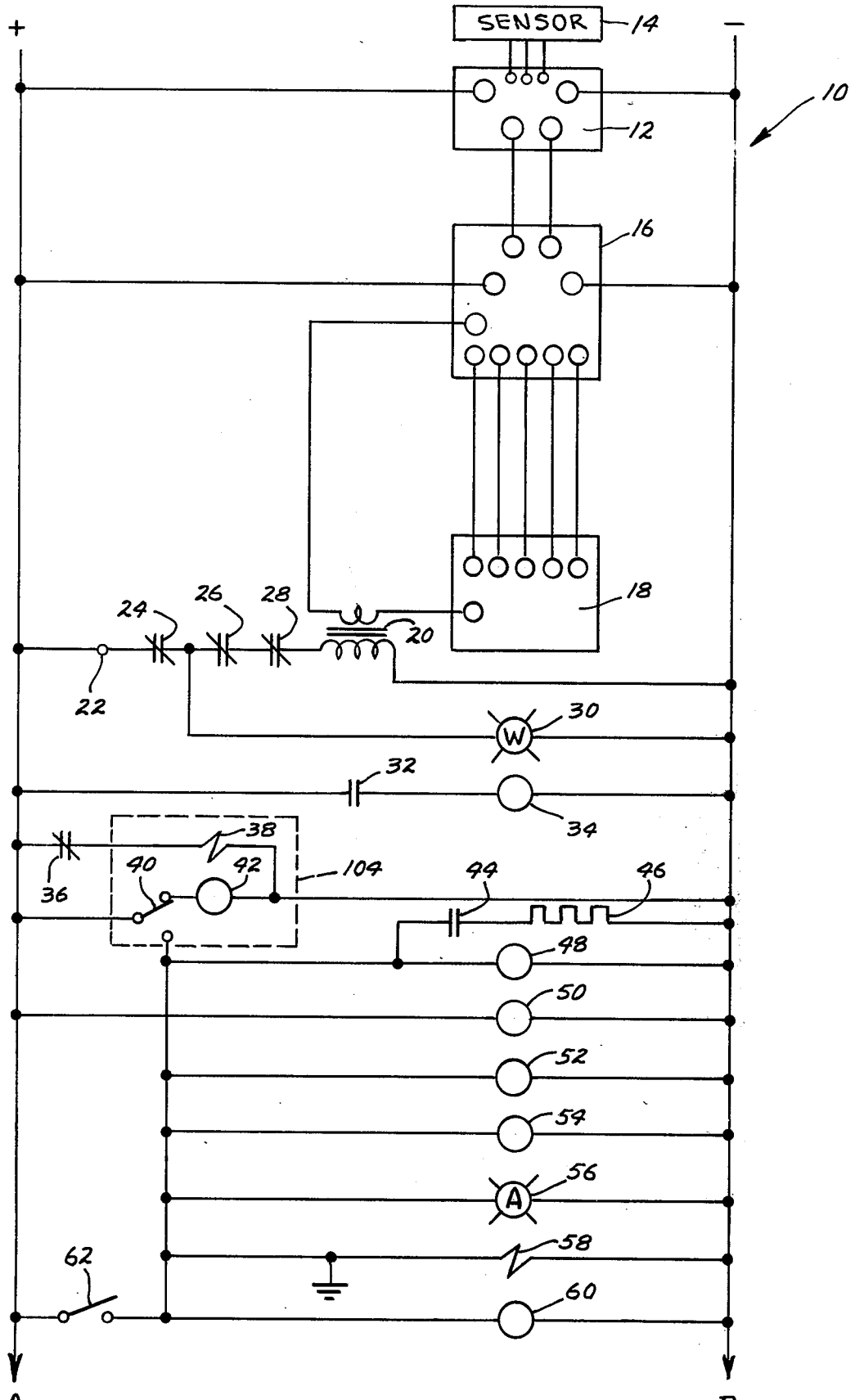
FIGS. 1A and 1B illustrate a circuit diagram of the invention.
Figure 1B:
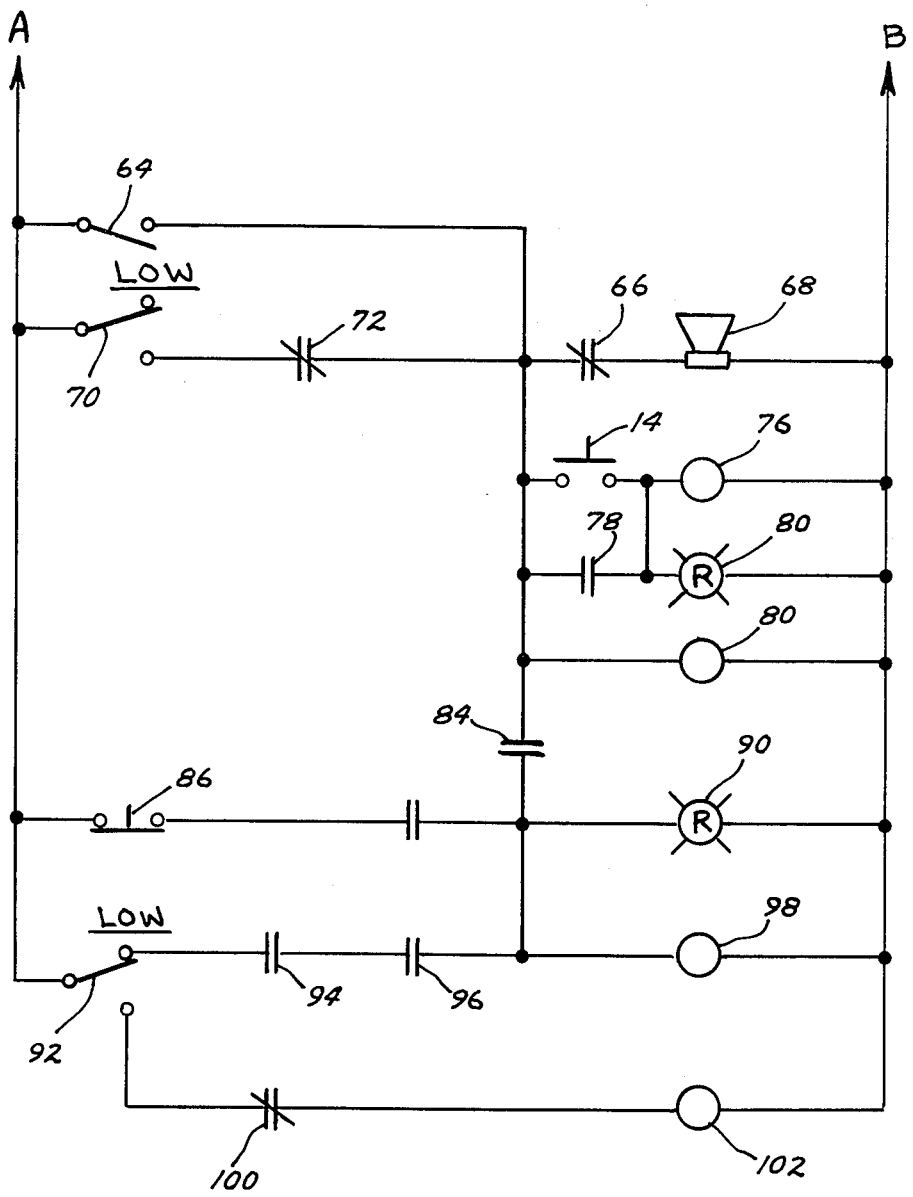

FIGS. 1A and 1B, which join at letters A and B, illustrates a circuit schematic of a gas monitor system 10 having an combustible or flammable gas monitor 12 which connects to a source of power such as ordinary household current labeled as plus, +, and minus, −, in the figure. A sensor 14 suitably connects between the equipment to be monitored and the combustible or flammable gas monitor 12. The sensor 14 is usually located on an outlet side of the damper in an exhaust flue of the equipment to be monitored, but may be placed on an inlet side of the damper. A control instrument 16 connects to the source of power and to the combustible or flammable gas monitor 12. A control motor 18 connects to control instrument 16 to operate the damper in the exhaust flue of the equipment to be monitored. A secondary winding of a control motor transformer 20 connects between the control motor 18 and the control instrument 16 forming an electrical closed-loop. A power supply interlock 22 of the equipment to be monitored, check relay normally closed contacts 24, damper open relay normally closed contacts 26, and damper latch relay normally closed contacts 28 connect in series with a primary winding of the control motor transformer 20 across the source of power. A pilot light 30 connects from the junction of damper open and damper latch relay normally closed contacts 24 and 26 respectively to the ground side of the power source. An off delay downcheck delay timer relay normally open contact 32 connects in series with a relay coil 34 across the power source.

The calibration circuitry is described below. Time delay relay normally closed contact 36 connects in series with timer 104 internal coil 38 across the power source. A switch 40 having one contact in series with monitor time motor 42 connects across the power source. From the lower contact of switch 40 to the minus side of the power source, off delay check timer relay normally open contacts 44 in series with time delay relay 46, off delay check timer relay coil 48, time delay coil 52, check relay coil 54, check light 56, calibrate valve 58, and relay coil 60 all connect in parallel. A single pole single throw momentary switch 62 connects from the positive side of the power source to the lower contact of the switch 40. A downcheck delay timer relay coil 50 having off-delay also connects across the power source.

A lower flammable limit fault relay 64 internal to the combustible or flammable gas monitor 12 connects in series with silence relay normally closed contacts 66 and alarm 68 across the power source. A lower flammable limit low set point relay 70 internal to the combustible or flammable gas monitor 12 indicating a low percentage level connects in series with off-delay downcheck delay timer normally closed relay contacts 72 from the positive side of the power source to the junction of the fault switch 64 and normally closed silence relay contacts 66. An alarm silence momentary toggle switch 74 in series with a silence relay coil 76, and silence relay normally open contacts 78 in series with an alarm silenced light 80 connect in parallel from the junction of the lower flammable limit fault relay 64 and normally closed silence relay contacts 66 to the minus side of the power source. A damper open relay coil 82 connects in parallel from the junction of lower flammable limit fault relay 64 and normally closed silence relay contacts 66 to the minus side of the power source. The junction of alarm silence switch 74 and silence relay coil 76 connects to the junction of normally open silence relay contacts 78 and alarm silenced light 80.

A normally closed momentary toggle switch 86, normally open damper latch relay contact 88, and out of calibration light 90 connect in series across the power source. Normally open check relay contacts 84 connect between the junction of normally closed down check delay timer contacts 72 and damper open relay coil 82, and the junctions of normally open damper latch relay contact 88 and out of calibration light 90 in addition to the junction of normally open check relay contact 96 and damper latch relay coil 98. A lower flammable limit high set point relay 92, internal to the combustible or flammable gas monitor 12, normally open time delay relay contact 94, normally open check relay contact 96, and damper latch relay coil 98 connect in series across the power source. Normally closed relay contact 100 in series with monitored equipment off relay coil 102 connects across the lower contact of the 92 and the minus side of the power supply.

PREFERRED MODE OF OPERATION

The gas monitor system 10 connects to a source of power through the plus and minus leads. The sensor 14 connects to the combustible or flammable gas monitor 10 such as for way of example and for purposes of illustration only a ERDCO 21D1 TOX-EX EXPLOSIVE GAS MONITOR and is suitably positioned in the exhaust flue of the equipment to be monitored on the outlet side of a damper although the sensor 14 may be placed on the inlet side of the damper or directly in the equipment to be monitored. The combustible or flammable gas monitor 12 connects to a compatible control instrument 16 such as a Honeywell Dialatrol having a 0 to 50 millivolt input. A control motor 18 connects to the control instrument 16 and forms a closed-loop feedback system to adjust the damper in the exhaust flue of the equipment to be monitored on a real time basis as the equipment is operating.

When power is initially applied to the system 10, the control motor 18 controlling the damper will begin to drive the damper to the closed position until the combustible or flammable gas concentration is reached as measured by the explosive gas monitor. The damper will then modulate to maintain the level set on the control instrument 16.

When running a process with combustible or flammable gases present, it is necessary to continually replace the gas in the equipment with fresh air to exhaust the combustible or flammable gases. The exhaust rate of the gas in the equipment to be replaced by fresh air is established at a predetermined minimum to maintain a desired percentage range of combustible or flammable gas concentration. Usually in a process, most of the volatile combustible or flammable gases are given off during the first portion of the process such as a heating cycle when drying paint in a heating oven. Running the entire process with the damper open to handle the maximum combustible or flammable gas exhaustion is obviously inefficient and wasteful, especially since most of the gases such as solvent in paint drying are generally expelled early in the heating or process cycle.

By monitoring the concentration level of combustible or explosive gases present in the equipment and automatically adjusting the damper to control the exhaust rate, the exhaust rate of heated air is automatically reduced as the combustible or flammable gases diminish thereby resulting in a considerable savings of heating fuel.

The control instrument 16 is set to keep the concentration of combustible or flammable gases within a defined percentage range. If the lower limit of the lower flammable level of gas concentration is sensed, the damper in the exhaust flue is opened by control motor 18 so as to purge the combustible or flammable gases from monitored equipment. If the combustible or flammable gases present fall within the tolerable percentage range, then control motor 18 varys the damper so as to regulate the exhaust of the combustible or flammable gases through the flue. If the combustible or flammable gas concentration level exceeds the upper percentage limit of the lower flammable limit of gas concentration, then alarm 68 will sound and the damper will drive open to rid the monitored equipment of the gas. When the lower flammable limit of combustible or flammable gases drops below the upper percentage limit, the alarm will be disabled and the control motor 18 again returns the damper to controlling the exhaust rate of the gases through the closed-loop on a real time basis.

If the lower flammable limit of combustible or flammable gas concentration continues to rise beyond the upper percentage level set point, then the monitored equipment relay coil 102 energizes to shut down the burner/heater of the monitored heating equipment and damper latch relay 98 energizes to open the damper. Fans of the monitored heating equipment continue to exhaust the combustible or flammable gases.

A monitor timer 104 consisting of internal coil 38, switch 40 and motor 42 determines the length of time that the combustible or flammable gas monitor 12 monitors the combustible or flammable gas concentration before going into the self-check automatic calibration cycle.

When timer 104 times out, check relay 54 energizes resulting in the damper control motor 18 to drive the damper to an open position. This prevents the monitored equipment from going to an unsafe condition while the combustible or flammable gas monitor 12 is in the calibration self-check cycle. Check relay 54 also closes relay contacts 84 and 96, respectively.

The off delay down check delay timer 50 is reset by relay 60 during the self calibrate cycle to disconnect the internal fault relays 70 and 92 internal to the combustible or flammable gas monitor 12 from the alarm circuit.

The off delay check timer 48 is also reset and begins timing to determine the length of the automatic self-check calibration period.

The calibration solenoid valve 58 now opens discharging and feeding a specific mixture of a known percentage of combustible or flammable gas to check the alarm circuit, the sensor, and the set points for the lower flammable limit of the combustible or flammable gas monitor 12. This discharge of gas results in a rise of the concentration of combustible or flammable gas to above the higher set point of the lower flammable limit of the explosive gas monitor 12.

When the combustible or flammable gas concentration exceeds the low set point of explosive gas monitor 12, the lower flammable limit low set point relay 70 internal to the combustible or flammable gas monitor 12 closes. The alarm 68 will not sound because normally closed off delay downcheck relay contact 72 opens when the timer 104 times to the check cycle.

The concentration of combustible or flammable gases increases until the lower flammable limit high set point relay 92 internal to the combustible or flammable gas monitor 12 closes. The alarm 68 again does not sound and monitored equipment relay 102 does not energize as normally closed relay contact 100 opens during the calibration check cycle which prevents the burner or other heating apparatus of the monitored equipment from shutting the equipment down.

Assuming that the combustible or flammable gas monitor 12 and sensor 14 is in calibration, nothing will happen. When on-delay check timer 48 times out, normally open relay contact 44 closes and on-delay relay 46 begins timing. When time delay relay 46 times out normally closed contact 36 opens and resets monitor timer 104, causing switch 40 to go back to the top motor contact. The calibration gas will be shut off through calibrate valve 58.

Off delay downcheck delay timer 50 begins timing for a certain time period allowing the sensed concentration of combustible or flammable gases of the lower flammable level on the combustible or flammable gas monitor 12 to drop below the lower flammable limit low set point before the normally closed contacts 72 close again or the alarm 68 sounds if the low set point is not reached within the time period. When the off delay downcheck relay timer 50 times out, normally open contacts 32 transfer and relay 34 deenergizes.

It should take less than the predetermined time period such as 10 seconds for way of example only for the explosive gas monitor 12 to exceed the lower flammable limit upper set point when sensing the calibration discharge of combustible or flammable gas concentration. If the combustible or flammable gas monitor 12 does not exceed the lower flammable limit upper set point within 10 seconds, normally open relay contact 94 close as the time delay 52 began began timing when the self-check calibration cycle began. When the time delay relay contact 94 close, the alarm 68 sounds and the damper locks open through damper latch relay coil 98 and contact 28. Contact 88 of relay 98 latches relay 98 which prevents damger motor 18 from closing until manually reset by pressing normally closed switch 86. Also, the out of calibration light 90 lights indicating the combustible or flammable gas monitor 12 is out of calibration or the sensor 14 is defective.

Various modifications are contemplated and may obviously be resorted to by those skilled in the art without departing from the apparent scope of the invention as hereinafter defined by the appended claims and only a preferred embodiment thereof has been disclosed. The period of time delays, the interval for the monitor timer 104 for the self-check calibration period, and the time periods for the lower flammable limit set points are selected for the type of combustible or flammable gases present.

Having thus described the invention, there is claimed as new and desired to be secured by Letters Patent:

1. Gas monitor system to monitor combustible or flammable gas concentration comprising equipment means containing generated combustible or flammable gases, an exhaust flue in connection with said equipment means, a damper rotatably mounted in said exhaust flue, a motor means connected to said damper, a motor control means connected to said motor, combustible or flammable gas monitor having upper and lower set points connected to said motor control means, a sensor connected to said combustible or flammable gas monitor and calibration means including means periodically locking the damper in an open position and means for contacting the sensor with a known calibration gas to check calibration of the gas monitor system, whereby said combustible or flammable gas monitor senses the lower flammable limit in said equipment means to regulate said damper through said motor control means.

2. Gas monitor system of claim 1 wherein said sensor is in said equipment means.

3. Gas monitor system of claim 1 wherein said sensor is in an inlet side of said damper.

4. Gas monitor system of claim 1 wherein said sensor is in an outlet side of said damper.

5. Gas monitor system of claim 1 wherein said motor control means connects to said motor means in a closed loop for real time control.

6. Gas monitor system of claim 1 further comprising alarm actuation means and damper opening means.

7. Gas monitor system of claim 1 further comprising equipment shut down means.

8. Gas monitor system of claim 1 wherein said calibration means further comprises a first timing means and a second timing means connected to said first timing means.

9. Gas monitor system of claim 8 further comprising a third timing means connected to said first timing means.

10. Gas monitor system of claim 9 further comprising a fourth timing means connected to said first timing means.

11. Gas monitor system of claim 10 further comprising a fifth timing means connected to said first timing means.

12. Gas monitor system of claim 8 wherein said first timing means comprises an interval time to perform calibration checks on a regular timed interval.

13. Gas monitor system of claim 8 wherein said first timing means comprises relay means to open said damper.

14. Gas monitor system of claim 8 wherein said first timing means comprises off delay relay means and an alarm means connected to said off delay relay means whereby said alarm is disabled by said off delay relay means.

15. Gas monitor system of claim 8 wherein said second timing means determines the length of said calibration period.

16. Gas monitor system of claim 9 further comprising alarm actuation means, damper latch open means, and out of calibration light means connected to said third timing means whereby said third timing means begins timing when said check cycle begins and actuates said alarm means, damper latch open means, out of calibration means if said third timing means times out before said calibration cycle is over.

17. Gas monitor system of claim 10 wherein said fourth timing means resets said first timing means.

18. Gas monitor system of claim 10 further comprising alarm actuation means connected to said fifth timing means whereby said alarm is actuated if said combustible or flammable gas monitor lower set point is not reached when said fifth timing means times out.

19. A gas monitor system to monitor the concentration of combustible gases in the exhaust flue of an oven or the like having an adjustable exhaust damper, the system comprising a combustible gas sensor mountable in the exhaust flue to sense the concentration of combustible gases therein, and calibration means comprising means for periodically contacting the sensor with a calibration gas and means for determining whether the sensed calibration gas concentration exceeds a predetermined elevated gas concentration.

20. The gas monitor system of claim 19 including timing means providing a fixed time period for the sensed calibration gas concentration to exceed the predetermined gas concentration, and means for signaling when the sensed calibration gas concentration has not exceeded the predetermined concentration within the fixed time period.

21. The gas monitor system of claim 19 including means responsive to the calibration means for fully opening the damper during periodic calibration and means locking the damper open in response to failure of the sensed calibration gas concentration to exceed the predetermined concentration.

* * * * *